US006283384B1

(12) United States Patent
Wyant et al.

(10) Patent No.: US 6,283,384 B1
(45) Date of Patent: Sep. 4, 2001

(54) FUEL INJECTOR WITH WELD INTEGRITY ARRANGEMENT

(75) Inventors: Gordon Wyant, Hampton; Michael Hornby, Williamsburg; Michael P. Dallmeyer, Newport News, all of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/447,412

(22) Filed: Nov. 23, 1999

(51) Int. Cl.[7] ..... F02D 1/06; B05B 1/30

(52) U.S. Cl. ..... 239/5; 239/585.4; 239/585.1; 285/288.5; 29/890.143

(58) Field of Search ..... 239/5, 585.1–585.5, 239/600; 251/129.21; 138/155; 285/288.1, 288.5, 288.6, 328, 93, 123.15; 228/103, 104, 105; 29/890.143

(56) References Cited

U.S. PATENT DOCUMENTS 2,073,093 * 3/1937 Brantly ..... 285/288.5 X
4,946,132 * 8/1990 Reiter ..... 239/585.4 X
5,018,555 * 5/1991 Hawerkamp ..... 285/288.5 X
5,301,874 * 4/1994 Vogt et al. ..... 239/585.4
5,395,050 * 3/1995 Nowak et al. ..... 239/585.4 X
5,775,600 * 7/1998 Wildeson et al. ..... 239/585.1 X
5,826,804 * 10/1998 Reiter et al. ..... 239/585.1

* cited by examiner

*Primary Examiner*—David A. Scherbel
*Assistant Examiner*—Steven J. Ganey
(74) *Attorney, Agent, or Firm*—Morgan, Lewis & Bockius LLP

(57) ABSTRACT

A fuel injector assembly with fluid communication cut-outs is disclosed which includes a method of forming a fuel injector that allows weld integrity evaluation between a shell and a body of the fuel injector, the fuel injector having a fuel inlet, a fuel outlet, a fuel passageway extending from the fuel inlet to the fuel outlet along a longitudinal axis, the body having an exterior surface, and the shell having an interior surface, the method including the steps of securing the shell to the exterior surface of the body, and cincturing the exterior surface of the body with the interior surface of the shell such that fluid communicates between the exterior surface of the body and the fuel passageway for particular weld integrities.

28 Claims, 2 Drawing Sheets

FUEL INJECTOR WITH WELD INTEGRITY ARRANGEMENT

BACKGROUND OF THE INVENTION

The present invention relates to a fuel injector assembly, and more particularly to a fuel injector assembly with a shell configured to allow fluid communication between an exterior surface of a body and a fuel passageway for particular weld integrities.

In a known system, the assembly of a fuel injector involves the insertion of a body into a shell. The body has an outside diameter which is slightly larger than the inside diameter of the shell. By this arrangement, an interference fit between the body and the shell is achieved. A lubricant is introduced on either or both of an exterior surface of the body and an interior surface of the shell to ease the insertion of the body into the shell. The body is hermetically attached to the interior surface of the shell by a weld. It is believed that both the use of a lubricant on and the use of an interference fit between the body and the shell lead to a few disadvantages. For example, during the forming of the weld, air and lubricant trapped between the body and the shell may become heated and expand in volume. The use of an interference fit between the body and the shell hinders the escape of the expanded air and lubricant. The integrity of the weld may be compromised, as the heated air and lubricant may expand through the weld. For these reasons, the use of an interference fit between a body and a shell of a fuel injector assembly necessitates a visual inspection of the weld.

It is further believed that due to the use of an interference fit between the body and the shell, pressure measurements upstream and downstream from the weld may not indicate whether the weld forms a hermetic seal. A satisfactory test result may only indicate that the interference fit between the body and the shell prevents the escape of a fluid.

SUMMARY OF THE INVENTION

The present invention provides a fuel injector having a fuel inlet, a fuel outlet, and a fuel passageway extending from the fuel inlet to the fuel outlet along a longitudinal axis. The fuel injector includes a body, an armature, a needle, and a shell. The body includes an inlet portion, an outlet portion, a body passage extending from the inlet portion to the outlet portion along the longitudinal axis, and an exterior surface. The armature is located adjacent the inlet portion of the body. The needle is operatively connected to the armature, the needle being positionable by the armature to permit or prohibit fuel flow through the fuel outlet. The shell includes a first end, a second end, and an interior surface disposed between the first end and the second end, the second end being welded to the exterior surface of the body, the interior surface cincturing the exterior surface of the body such that fluid communicates between the exterior surface of the body and the fuel passageway for particular weld integrities. Preferably, the interior surface of the shell includes a cut-out through which fluid communicates between the exterior surface of the body and the fuel passageway, a contact surface and a non-contact surface, the contact surface defining an area of contact between the interior surface of the shell and the exterior surface of the body, the non-contact surface being adjacent the fuel inlet of the fuel passageway, the cut-out extending a non-zero length of the non-contact surface and substantially an entire length of the contact surface. Preferably, the particular weld integrities are a fillet weld with a hermetic seal.

The present invention also provides a shell for a fuel injector having a fuel inlet, a fuel outlet, a fuel passageway extending from the fuel inlet to the fuel outlet, and a body with an exterior surface. The shell includes a first end, a second end, and an interior surface disposed between the first end and the second end. The interior surface includes a cut-out. Preferably, the interior surface of the shell is configured to cincture the exterior surface of the body such that fluid communicates between the exterior surface of the body and the fuel passageway for particular weld integrities. Preferably, the particular weld integrities are a fillet weld with a hermetic seal.

The present invention also provides a method of forming a fuel injector that allows weld integrity evaluation between a shell and a body of the fuel injector, the fuel injector having a fuel inlet, a fuel outlet, a fuel passageway extending from the fuel inlet to the fuel outlet along a longitudinal axis, the body having an exterior surface, and the shell having an interior surface. The method includes the steps of securing the shell to the exterior surface of the body, and cincturing the exterior surface of the body with the interior surface of the shell such that fluid communicates between the exterior surface of the body and the fuel passageway for particular weld integrities. Preferably, the interior surface of the shell includes a cut-out through which fluid communicates between the exterior surface of the body and the fuel passageway. Preferably, the particular weld integrities are a fillet weld with a hermetic seal.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

Figure 1:
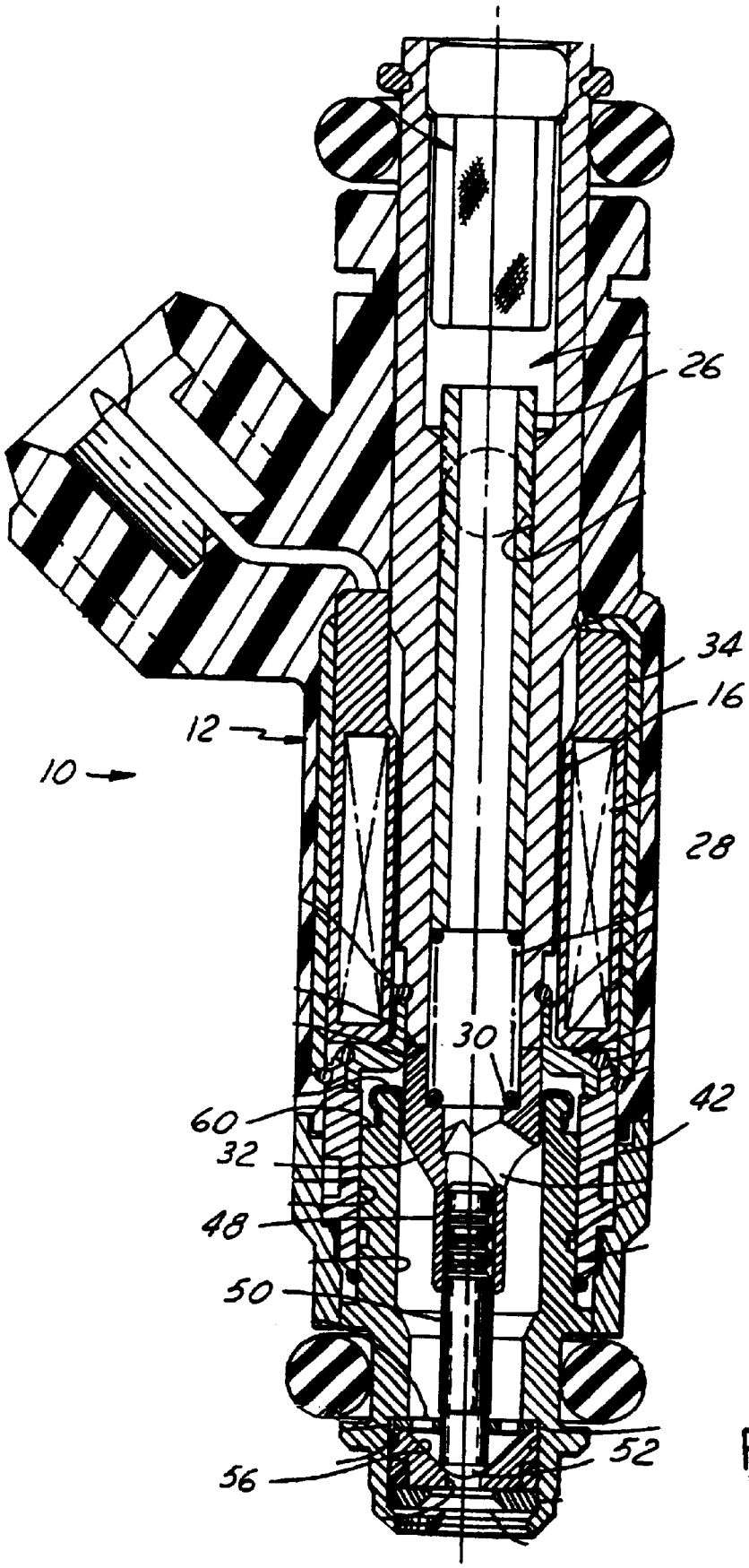
FIG. 1 shows a cross-sectional view of a fuel injector assembly according to the present invention.

FIG. 1 shows a cross-sectional view of a fuel injector according to the present invention. A fuel injector assembly 10 includes a housing 12. The housing 12 includes electrical connector portions (not shown) which are used in the operation of the fuel injector. A fuel inlet 16 extends out of the upper end of the housing 12 for installation in a fuel rail (not shown).

The fuel injector assembly 10 includes an adjustment tube 26. A compression spring 28 is located at a downstream end of the adjustment tube 26. The compression spring 28 is disposed within a bore 30 of an armature 32.

A solenoid coil (not shown) within a solenoid coil assembly 34 may be energized, thereby magnetically attracting the armature 32 in a direction which is contrary to that urged by the compression spring 28. The armature 32 includes a reduced diameter tubular end 48 having a needle 50 operatively connected thereto. The needle 50 includes a lower end 52. The lower end 52 of the needle 50 is substantially somewhat spherical in shape. The compression spring 30 urges the lower end 52 of the needle 50 towards a substantially conical surface of a seat 56. The fuel injector assembly also includes a body 42 and a shell 60. The shell 60 includes a fuel inlet portion 612. The armature 32 is installed adjacent the fuel inlet portion 612 of the shell 60. The body 42 acts to guide the armature 32 when the solenoid coil assembly 34 is energized and when the solenoid coil assembly is de-energized and the armature 32 is urged in the opposite direction by the compression spring 30. The shell 60 is fillet welded to the body 42. The shell 60, the body 42, and the fillet weld will be described in greater detail later.

When the lower end 52 of the needle 50 is removed from contact with the substantially conical surface of the seat 56, fuel heretofore entrapped within a fuel passageway is allowed to flow through a fuel outlet of the fuel injector assembly 10. When the lower end 52 of the needle 50 is returned to contact with the substantially conical surface of the seat 56, fuel flow is prohibited through the fuel outlet of the fuel injector assembly. By this arrangement, the needle is positioned by the armature either to permit or to prohibit fuel flow through the fuel outlet. Further details of a fuel injector assembly can be found in U.S. Pat. No. 5,775,600 to Wildeson et al., issued on Jul. 7, 1998, which is incorporated by reference herein in its entirety.

Figure 2:
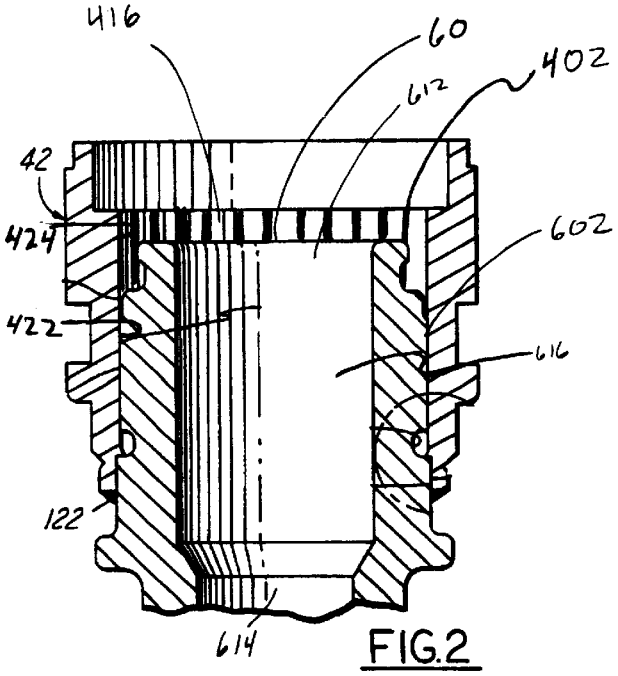
FIG. 2 shows an enlarged sectional view of a portion of the body and the shell of FIG. 1.
Figure 4:
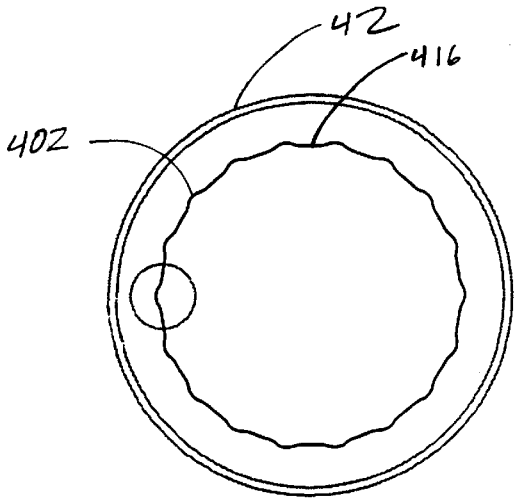
FIG. 4 shows a top view of the shell according to the present invention.
Figure 3:
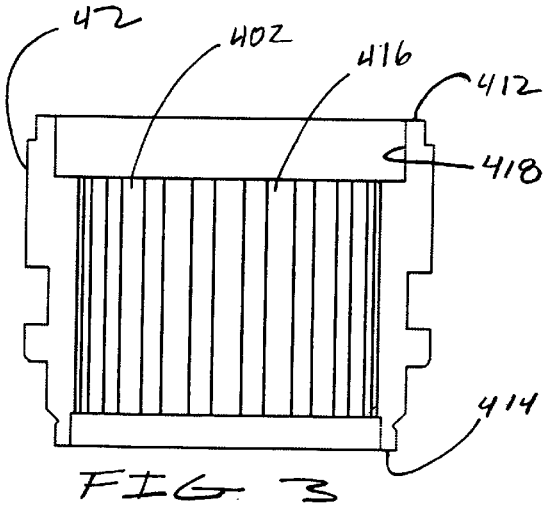
FIG. 3 shows a cross-sectional view of the shell according to the present invention.

FIG. 2 shows an enlarged sectional view of a portion of the body and the shell of FIG. 1. FIG. 3 shows a cross-sectional view of the shell according to the present invention. FIG. 4 shows a top view of the shell according to the present invention. The body 60 includes an exterior surface 602, a fuel outlet portion 614, and an body passage 616 extending between the fuel inlet portion 612 and the fuel outlet portion 614. The shell 42 includes a first end 412 and a second end 414. An interior surface 416 is disposed between the first and second ends 412, 414. The interior surface 416 includes cut-outs 402 through which fluid communicates between the exterior surface 602 of the body 60 and the fuel passageway. The interior surface 416 also includes contact and non-contact surfaces 422 and 424, respectively. The non-contact surface 424 includes a continuous radial passage 418. When the body 60 is inserted into the shell 42, the exterior surface 602 of the body 60 is cinctured by the contact surface 422 of the interior surface 416 of the shell 42 such that fluid communicates between the exterior surface 602 of the body 60 and the fuel passageway for particular weld integrities. The continuous radial passage 418 has a larger diameter than the contact surface 422 and is in fluid communication with the cut-outs 402. Preferably, the particular weld integrities are a fillet weld with a hermetic seal. Preferably, the exterior surface 602 of the body 60 is captured by the interior surface 416 of the shell 42 by an interference fit without a lubricant. A fillet weld 122 joins the exterior surface 602 of the body 60 to the second end 414 of the shell 42. Preferably, the fillet weld 122 is a fillet weld forming a hermetic seal.

As shown in FIG. 3, the cut-outs 402 may extend a substantially entire length of the interior surface 416 of the shell 42. However, the cut-outs need only extend a substantially entire length of the contact surface 424 of the interior surface 416 of the shell 42 and a non-zero length of the non-contact surface 422 of the interior surface 416 of the shell 42 such that fluid communicates between the exterior surface 602 of the body 60 and the fuel passageway. As shown in FIGS. 3 and 4, the shell 42 may have a multiplicity of cut-outs 402. Preferably, the shell 42 has eighteen cut-outs 402. However, the shell 42 may any number of cut-outs 402. Preferably, the cut-outs 402 will be distributed substantially symmetrically about the interior surface 416 of the shell 42. However, the cut-outs 402 may be distributed non-symmetrically about the interior surface 416 of the shell 42. The number of cut-outs 402 and the distribution of the cut-outs 402 along the interior surface 416 of the shell 42 may be chosen such that a number of criteria are satisfied. These criteria include the ease of insertion of the body 60 into the shell 42, the amount of lubrication desired to be used in the assembly of the body 60 and the shell 42, the ease of alignment of the exterior surface 602 of the body 60 with the interior surface 416 of the shell 42, etc. The cut-outs 402 are substantially circular in cross-section. However, the cross-section of the cut-outs 402 may be of a variety of shapes. These shapes include, but are not limited to, circles, ellipses, ovals, rectangles, triangles, polygons, arcs, or combinations of one or more of these shapes, or like shapes having similar desired properties. The cut-outs 402 may be of any width. Preferably, each of the cut-outs 402 will have a width of at least about 2.7% of the interior surface 416 of the shell 42.

The exterior surface 602 of the body 60 may also include cut-outs (not shown) in lieu of, or in combination with, the cut-outs 402 on the interior surface 416 of the shell 42. The various attributes of the cut-outs on the exterior surface 602 of the body 60 will be similarly chosen to satisfy the requirements as discussed above.

The integrity of the fillet weld 122 may be evaluated through the use of a test stand (not shown). After the body 60 is joined with the shell 42, the fuel injector assembly 10 may be disposed within a test stand, such that a first pressure is applied and measured on an upstream side of the fuel injector assembly 10, and a second pressure is applied and measured on a downstream side of the fuel injector assembly 10. Preferably, the first pressure is greater than the second pressure, and preferably, the second pressure is substantially a vacuum. Changes in the first pressure and the second pressure are then evaluated. By this arrangement, it may be ascertained at to whether the fillet weld 122 joining the body 60 and the shell 42 is hermetic.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What we claimed is:

1. A fuel injector having a fuel in let, a fuel outlet, and a fuel passageway extending from the fuel inlet to the fuel outlet along a longitudinal axis, the fuel injector comprising:

a body comprising an inlet portion, an outlet portion, a body passage extending from the inlet portion to the outlet portion along the longitudinal axis, and an exterior surface;

an armature adjacent the inlet portion of the body;

a needle operatively connected to the armature, the needle being positionable by the armature to permit or prohibit fuel flow through the fuel outlet; and a shell comprising a first end, a second end, and an interior surface disposed between body, the interior surface cincturing the exterior surface of the body such that fluid communicates between the exterior surface of the body and the fuel passageway for particular weld integrities between the second end of the shell and the exterior surface of the body.

2. The fuel injector according to claim 1, wherein the interior surface of the shell comprises at least one cut-out and a continuous radial passage through which the fluid communicates between the exterior surface of the body and the fuel passageway.

3. The fuel injector according to claim 2, wherein the interior surface of the shell comprises a contact surface and a non-contact surface, the contact surface defining an area of contact between the interior surface of the shell and the exterior surface of the body, the non-contact surface being adjacent the fuel inlet of the fuel passageway, the at least one cut-out extending a non-zero length of the non-contact surface and substantially an entire length of the contact surface.

4. The fuel injector according to claim 2, wherein the at least one cut-out extends a substantially entire length of the interior surface of the shell.

5. The fuel injector according to claim 4, wherein the at least one cut-out comprises a width of at least about 2.7% of the interior surface of the shell.

6. The fuel injector according to claim 2, wherein the at least one cut-out comprises a width of at least about 2.7% of the interior surface of the shell.

7. The fuel injector according to claim 6, wherein the at least one cut-out comprises a substantially circular cross-section.

8. The fuel injector according to claim 2, wherein the at least one cut-out comprises a substantially circular cross-section.

9. The fuel injector according to claim 2, wherein the shell comprises a plurality of cut-outs, the cut-outs located at substantially equal intervals along the interior surface of the shell.

10. The fuel injector according to claim 9, wherein the plurality of cut-outs extend a substantially entire length of the interior surface of the shell.

11. The fuel injector according to claim 10, wherein the shell comprises 18 cut-outs.

12. The fuel injector according to claim 11, wherein the plurality of cut-outs comprise a substantially circular cross-section.

13. The fuel injector according to claim 12, wherein the plurality of cut-outs each comprise a width of at least about 2.7% of the interior surface of the shell.

14. The fuel injector according to claim 9, wherein the interior surface of the shell comprises a contact surface and a non-contact surface, the contact surface defining an area of contact between the interior surface of the shell and the exterior surface of the body, the non-contact surface being adjacent the fuel inlet of the fuel passageway, the plurality of cut-outs extending a non-zero length of the non-contact surface and substantially an entire length of the contact surface.

15. The fuel injector according to claim 1, wherein the weld attaching the exterior surface of the body and the second end of the shell comprises a fillet weld, the fillet weld forming a hermetic seal.

16. A shell for a fuel injector having a fuel inlet, a fuel outlet, a fuel passageway extending from the fuel inlet to the fuel outlet, and a body with an exterior surface, the shell comprising:

a first end;

a second end; and an interior surface disposed between the first end and the second end, the interior surface comprising at least one cut-out, wherein the second end of the shell is welded to the exterior surface of the body and the interior surface of the shell is configured to cincture the exterior surface of the body such that fluid communicates between the exterior surface of the body and the fuel passageway through the at least one cut-out for particular weld integrities between the second end of the shell and the exterior surface of the body.

17. The shell according to claim 16, wherein the weld attaching the second end of the shell and the exterior surface of the body comprises a fillet weld with a hermetic seal.

18. The shell according to claim 16, wherein the interior surface of the shell comprises a contact surface and a non-contact surface, the contact surface defining an area of contact between the interior surface of the shell and the exterior surface of the body, the non-contact surface being adjacent the fuel inlet of the fuel passageway, the at least one cut-out extending a non-zero length of the non-contact surface and substantially an entire length of the contact surface.

19. The shell according to claim 18, wherein the at least one cut-out extends a substantially entire length of the interior surface of the shell.

20. The shell according to claim 19, wherein the shell comprises a plurality of cut-outs, the cut-outs located at substantially equal intervals along the interior surface of the shell.

21. A method of forming an apparatus that allows weld integrity evaluation between a first component and a second component of the apparatus, the apparatus having an inlet, an outlet, a passageway extending from the inlet to the outlet, the first component having an exterior surface, and the second component having an interior surface, the method comprising the steps of:

welding the second component to the exterior surface of the first component; and cincturing the exterior surface of the first component with the interior surface of the second component such that fluid communicates between the exterior surface of the first component and the passageway for particular weld integrities between the second component and the exterior surface of the first component.

22. The method of forming an apparatus according to claim 21, further comprising the step of:

providing a cut-out on the interior surface of the second component through which the fluid communicates between the exterior surface of the first component and the passageway.

23. The method of forming an apparatus according to claim 21, wherein the step of welding the second component to the exterior surface of the first component includes producing a fillet weld that forms a hermetic seal.

24. The method of forming an apparatus according to claim 21, further comprising the step of:

capturing the exterior surface of the first component with the interior surface of the second component, the exterior surface of the first component and the interior surface of the second component achieving an interference fit without a lubricant.

25. A method of forming a fuel injector including a fuel inlet, a fuel outlet, and a fuel passageway extending from the fuel inlet to the fuel outlet, the method allowing weld integrity evaluation between a body and a shell of the fuel injector, comprising the step of:

constructing the body comprising an inlet portion, an outlet portion, a body passage extending from the inlet portion to the outlet portion along a longitudinal axis, and an exterior surface;

installing an armature adjacent the inlet portion of the body;

connecting a needle to the armature such that the needle is positionable by the armature to permit or prohibit fuel flow through the fuel outlet;

constructing the shell comprising a first end, a second end, and an interior surface, wherein the interior surface is disposed between the first end and the second end; and welding the second end of the shell to the exterior surface of the body.

26. The method of forming a fuel injector according to claim 25, further comprising the step of:

forming a cut-out on the interior surface of the shell through which the fluid communicates between the exterior surface of the body and the fuel passageway.

27. The method of forming a fuel injector according to claim 25, wherein the step of welding includes producing a fillet weld which forms a hermetic seal.

28. The method of forming a fuel injector according to claim 27, further comprising the steps of:

applying and measuring a first pressure to the fuel injector at an upstream location;

applying and measuring a second pressure to the fuel injector at a downstream location; and comparing changes in the first pressure and the second pressure to evaluate the hermetic seal of the fillet weld.

* * * * *